US010927721B2

(12) United States Patent
Mlinaric

(10) Patent No.: US 10,927,721 B2
(45) Date of Patent: Feb. 23, 2021

(54) OIL RESERVOIR FOR CAMSHAFT PHASER

(71) Applicant: Schaeffler Technologies AG & Co. KG, Herzogenaurach (DE)

(72) Inventor: Andrew Mlinaric, Lakeshore (CA)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/565,580

(22) Filed: Sep. 10, 2019

(65) Prior Publication Data

US 2020/0095906 A1 Mar. 26, 2020

Related U.S. Application Data

(60) Provisional application No. 62/733,777, filed on Sep. 20, 2018.

(51) Int. Cl.
*F01L 1/34* (2006.01)
*F01L 1/344* (2006.01)

(52) U.S. Cl.
CPC ..... *F01L 1/3442* (2013.01); *F01L 2001/3443* (2013.01)

(58) Field of Classification Search
CPC ... F01L 1/3442; F01L 1/3443; F01L 1/34483; F01L 1/34433; F01L 2820/041; F01L 2250/02
See application file for complete search history.

(56) References Cited

U.S. PATENT DOCUMENTS

| | | | | |
|---|---|---|---|---|
| 10,156,165 | B2 | 12/2018 | Scheidig et al. | |
| 10,329,967 | B2 | 6/2019 | Camilo et al. | |
| 2005/0103297 | A1 * | 5/2005 | Simpson | F01L 1/022 123/90.17 |
| 2018/0334931 | A1 | 11/2018 | Camilo et al. | |

FOREIGN PATENT DOCUMENTS

| | | | | |
|---|---|---|---|---|
| DE | 102015208453 | B3 | 6/2016 | |
| DE | 102016218793 | A1 * | 6/2017 | F01L 1/3442 |
| WO | 2017162233 | A1 | 9/2017 | |

* cited by examiner

*Primary Examiner* — Zelalem Eshete
(74) *Attorney, Agent, or Firm* — Matthew V. Evans

(57) ABSTRACT

A camshaft phaser includes a reservoir cover on a rear side, facing the cams, and a timing wheel on a front side. Fluid is routed from the oil control valve to the reservoir via radial channels defined between a rear cover and a thrust interface. Fluid may also be routed from a radial bearing to the reservoir via these channels. A spool in the oil control valve assembly has an internal passageway to route fluid from a front cavity to the radial channels.

20 Claims, 7 Drawing Sheets

OIL RESERVOIR FOR CAMSHAFT PHASER

CROSS-REFERENCE TO RELATED APPLICATIONS

This application claims priority to U.S. Provisional Application 62/733,777 filed Sep. 20, 2018, the entire disclosure of which is incorporated by reference herein.

TECHNICAL FIELD

This invention is generally related to a camshaft phaser of an internal combustion (IC) engine.

BACKGROUND

FIG. 1 schematically illustrates a portion of a piston engine valve system. Crankshaft 10 rotates in response to combustion of fuel in cylinders. First sprocket 12 is fixed to the crankshaft 10. Second sprocket 14 is driven by the first sprocket 12 via chain 16. The relative sizes of sprockets 12 and 14 cause sprocket 14 to rotate once for every two revolutions of sprocket 12. Camshaft 18 is driven by sprocket 14 such that it rotates once for every two rotations of crankshaft 10. Cams on camshaft 18 actuate valves that permit flow of air/fuel mixture into cylinders and permit flow of combustion products out of cylinders at appropriate times during the power cycle.

In some engines, camshaft 18 is fixedly coupled to sprocket 18. In such systems, the valves open and close at the same crankshaft position regardless of operating condition. The engine designer must select valve opening and closing positions that provide acceptable performance in all operating conditions. This often requires a compromise between positions optimized for engine starting and for high speed operation.

To improve performance across variable operating conditions, some engines utilize a variable cam timing mechanism 20 that allows a controller to vary a rotational offset between sprocket 14 and camshaft 18.

SUMMARY

A camshaft phaser includes a stator, a rotor, front and rear covers, a reservoir cover, and a timing wheel. The front and rear covers are fixed to the stator. The stator, rotor, and front and rear covers define A-chambers and B-chambers such that a volume ratio between the A-chambers and the B-chambers varies as a function of a rotational position of the rotor relative to the stator. The reservoir cover forms a fluid reservoir with the rear cover. The fluid reservoir is connected to the A-chambers and the B-chambers by one-way valves. The timing wheel is fixed to the rotor adjacent to the front cover. The rear cover may define radial channels configured to route lubrication fluid from a radial bearing interface to the fluid reservoir. An oil control valve assembly may be configured to route fluid according to a first mode, a second mode, and a third mode. In the first mode, pressurized fluid is routed to both the A-chambers and the B-chambers simultaneously. In the second mode, pressurized fluid is routed to the A-chambers while fluid from the B-chambers is routed to the fluid reservoir. In the third mode, pressurized fluid is routed to the B-chambers while fluid from the A-chambers is routed to the fluid reservoir. The rear cover may define radial channels configured to route lubrication fluid from a radial bearing interface to the fluid reservoir in the first mode. The oil control valve assembly may include a hydraulic unit and a spool valve having three lands. The hydraulic unit and spool valve may define a first and a second cavity. The hydraulic unit may define a first passageway leading to the radial channels, a second passageway leading to the A-chambers, and a third passageway leading to the B-chambers. The second cavity may be fluidly connected to the first passageway.

A camshaft phaser includes a stator, a rotor, a camshaft, front and rear covers, and a reservoir cover. The camshaft is fixed to the rotor at one end and has a set of valve actuating cams. The front cover fixed to the stator on a side opposite the cams. The rear cover is fixed to the stator on a side toward the cams. The stator, rotor, and front and rear covers define A-chambers and B-chambers wherein a volume ratio between the A-chambers and the B-chambers varies as a function of a rotational position of the rotor relative to the stator. The reservoir cover forms a fluid reservoir with the rear cover. The fluid reservoir is connected to the A-chambers and the B-chambers by one-way valves. A timing wheel may be fixed to the rotor on the side opposite the cams.

A camshaft phaser includes a stator, a rotor, a rear cover, a front cover, and a reservoir cover. The rear cover is fixed to the stator and has a thrust surface adapted to transmit axial forces to a stationary housing and to cooperate with the housing to define fluid channels. The front cover is fixed to the stator. The stator, rotor, and front and rear covers define A-chambers and B-chambers wherein a volume ratio between the A-chambers and the B-chambers varies as a function of a rotational position of the rotor relative to the stator. The reservoir cover forms a fluid reservoir with the rear cover. The fluid reservoir is configured to receive fluid via the fluid channels and to provide fluid to the A-chambers and the B-chambers via one-way valves. A timing wheel may be fixed to the rotor adjacent to the front cover. The fluid channels may be configured to route lubrication fluid from a radial bearing interface to the fluid reservoir.

DETAILED DESCRIPTION OF EMBODIMENTS

Embodiments of the present disclosure are described herein. It should be appreciated that like drawing numbers appearing in different drawing views identify identical, or functionally similar, structural elements. Also, it is to be understood that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The terminology used herein is for the purpose of describing particular aspects only, and is not intended to limit the scope of the present disclosure. Unless defined otherwise, all technical and scientific terms used herein have the same meaning as commonly understood to one of ordinary skill in the art to which this disclosure belongs. Although any methods, devices or materials similar or equivalent to those described herein can be used in the practice or testing of the disclosure, the following example methods, devices, and materials are now described.

Figure 1:
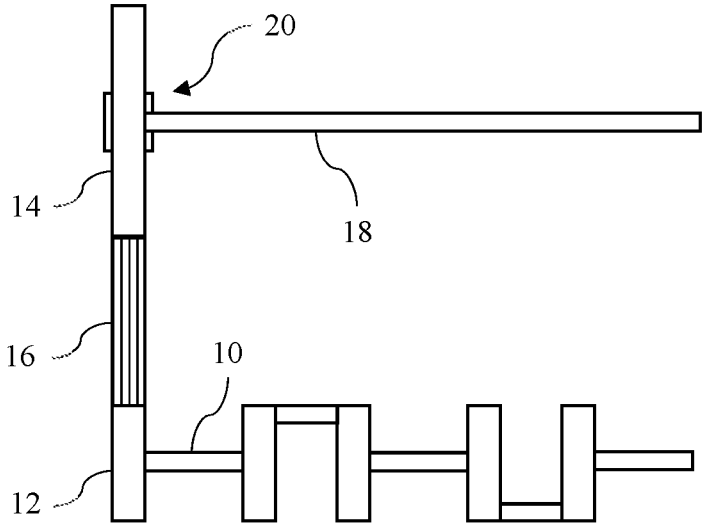
FIG. 1 (PRIOR ART)
FIG. 1 is a schematic illustration of a camshaft drive.
Figure 2:
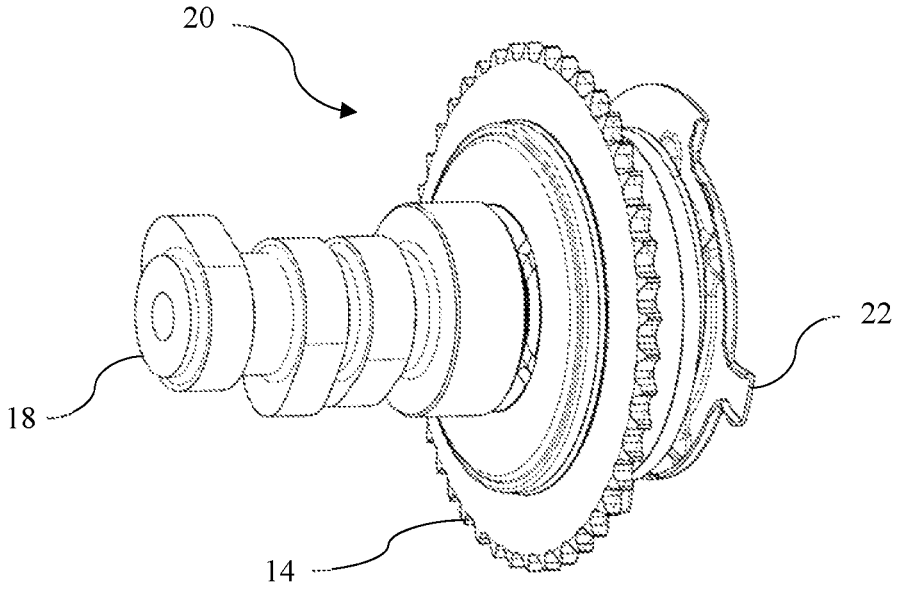
FIG. 2 is a pictorial view of a cam phaser and a camshaft.

FIG. 2 shows a variable valve timing mechanism 20 known as a cam phaser. Sprocket 14 is driven by the crankshaft via a chain. Camshaft 18 is driven by sprocket 14 with a phase offset determined by the cam phaser 20. A timing wheel 22 is fixed to the cam phaser rotor, enabling a sensor to accurately measure a current phase offset.

Figure 3:
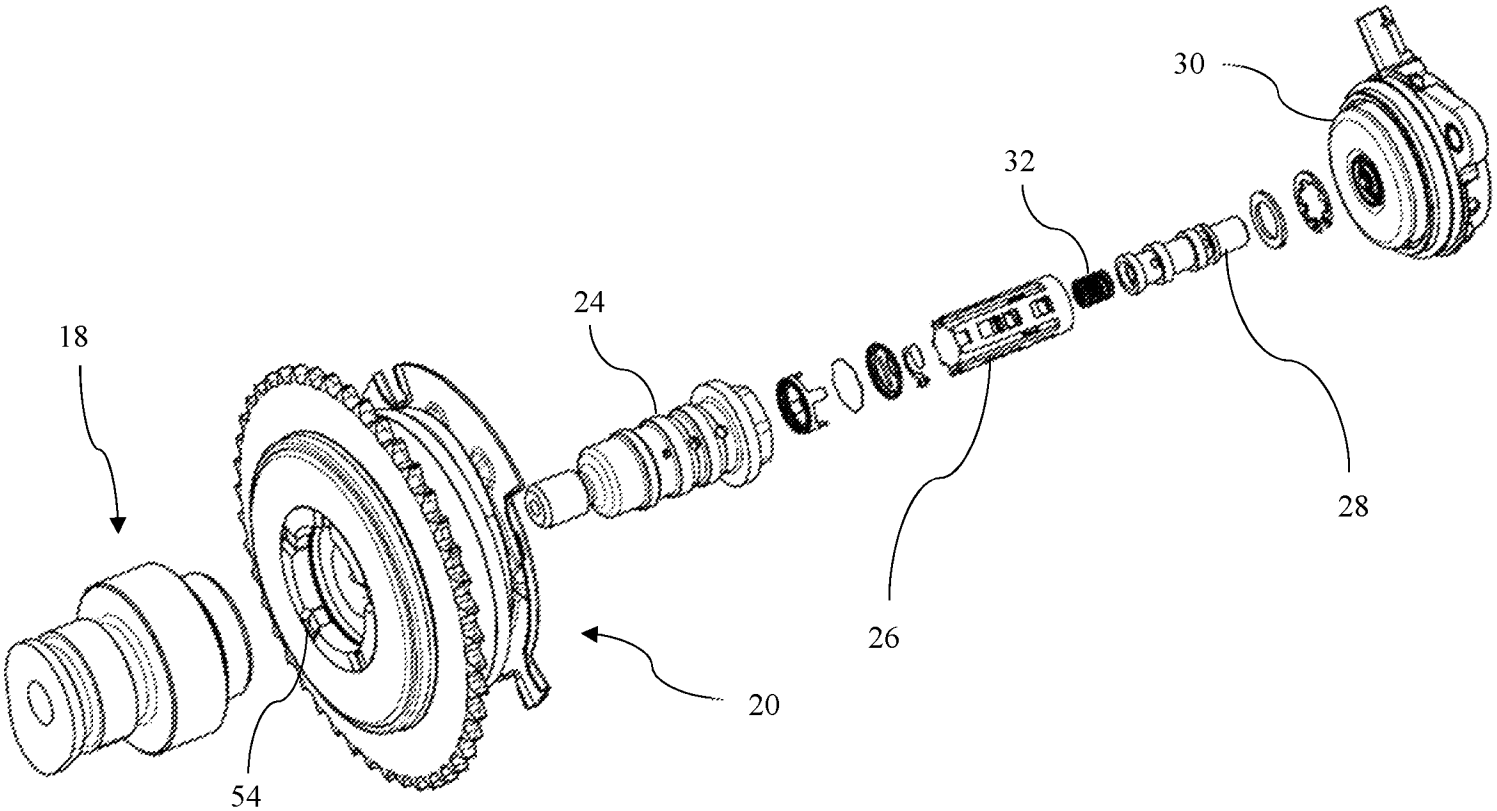
FIG. 3 is an exploded pictorial view of a cam phaser and associated actuation mechanism.

FIG. 3 shows the cam phaser and the associated actuation mechanism in an exploded view. An oil control valve housing 24 extends through cam phaser 20 into camshaft 18. Hydraulic unit 26 is inserted into oil control valve housing 24. Spool 28 slides within hydraulic unit 26 in response to force exerted by solenoid 30. Spring 32 pushes spool 28 in the opposite direction of solenoid 30 such that the position of spool 28 with respect to hydraulic unit 26 is a function of an electrical current supplied to the solenoid.

Figure 4:
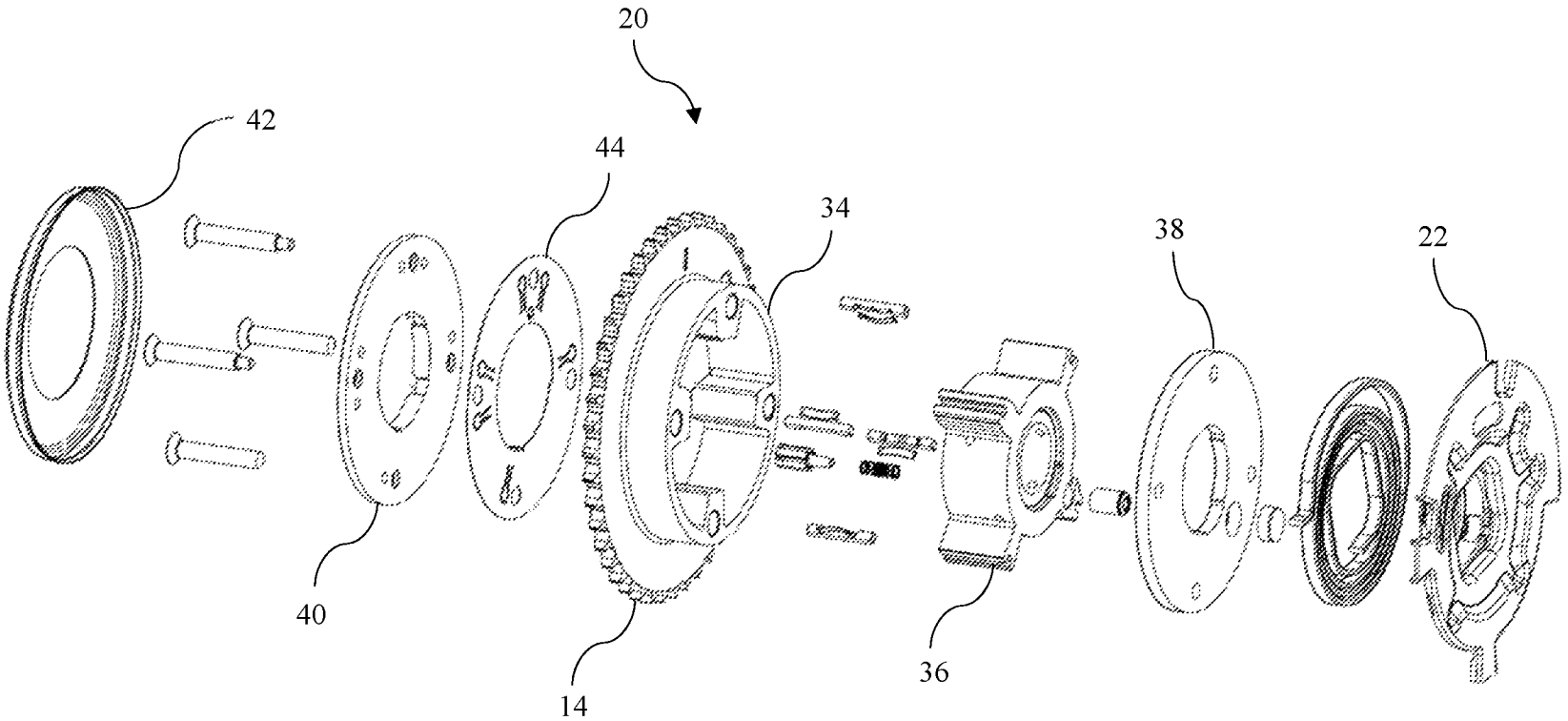
FIG. 4 is an exploded pictorial view of the cam phaser.

FIG. 4 illustrates the internal components of cam phaser 20. Stator 34 is fixed to sprocket 14. Rotor 36 is supported within stator 34. Vanes of rotor 36 are interspersed circumferentially with internal radial protrusions of stator 34 to define a number of chambers. The chambers on one side of the vanes are called A-chambers while the chambers on the opposite side of the vanes are called B-chambers. As the rotor 36 rotates clockwise with respect to stator 34, the volume of the A-chambers increases and the volume of the B-chambers decreases. Conversely, as the rotor 36 rotates counter-clockwise with respect to stator 34, the volume of the A-chambers decreases and the volume of the B-chambers increases. As will be discussed later, this relationship is used to adjust the rotational position of the rotor with respect to the stator by supplying fluid at differing pressures to the A-chambers and B-chambers. High pressure fluid is forced into one set of chambers causing the volume to increase while fluid at a lower pressure is allowed to flow out of the opposite chambers as their volume decreases.

The axial ends of the chambers are defined by front cover 38 and rear cover 40 which are fixed to stator 34 by bolts. In this context, the side facing away from the camshaft is called the front and the side toward the camshaft is called the back, regardless of which end of the engine the assembly is located on or how the engine is positioned within the vehicle. Additional features and components secure the rotor to the front cover in the absence of hydraulic pressure. Reservoir cover 42 connects to the rear of the stator and, together with rear cover 40, creates a fluid reservoir. Check valve plate 44 is sandwiched between the rear cover 40 and the stator 34. Holes in the rear cover and features of the check valve plate create a one-way flow path from the reservoir to the A-chambers and B-chambers. If the pressure in one of the chambers falls below the pressure in the reservoir, fluid flows from the reservoir to the low-pressure chamber. This can occur, for instance, when torque exerted on the camshaft by the valvetrain momentarily accelerates the camshaft causing an acceleration of the cam phaser rotor and a pressure drop in the A-chamber or B-chamber. When the pressure drops below the pressure in the reservoir, oil flows from the reservoir to fill the chamber, preventing further pressure drop. Preventing a vacuum from forming in the chambers makes the adjustment faster, more controllable, and prevents noise.

Fluid is trapped in the reservoir by centrifugal force as the assembly spins. Conventionally, the reservoir is filled by fluid that is drained from the chambers. In prior art cam phasers with such a reservoir, the reservoir is located on the front side such that fluid exiting the front of the oil control valve flows to the reservoir. However, locating the reservoir on the front of the assembly is incompatible with locating a trigger wheel on the front of the assembly. Thus, the reservoir has been moved to the rear and a system, which is described below, has been developed to fill the reservoir with fluid.

Figure 5:
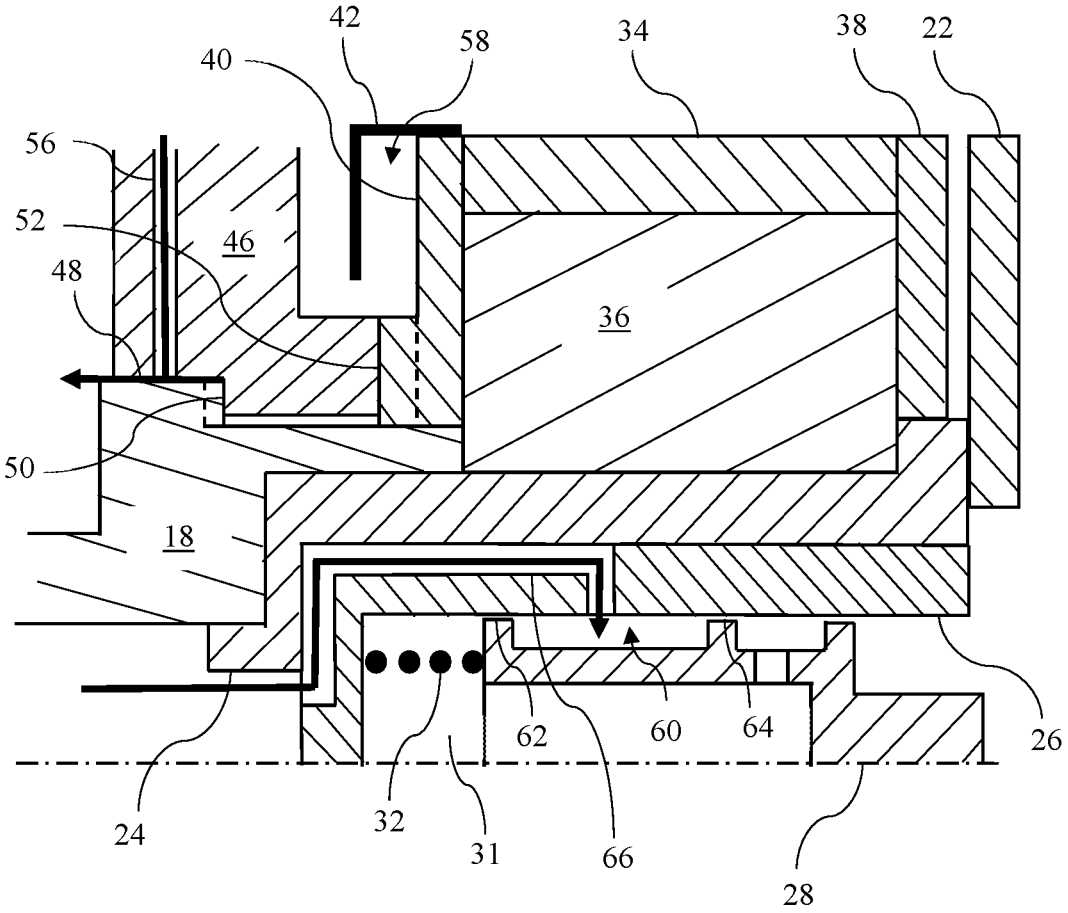
FIG. 5 is a first cross section view of the cam phaser and associated actuation mechanism.

FIG. 5 is a conceptual cross-section of the cam phase adjustment mechanism. Parts are not necessarily drawn to scale but are rather drawn to facilitate illustration of the functionality. The cross-section of FIG. 5 is taken at a circumferential location which illustrates how pressurized fluid is supplied to the oil control valve. Some features are axisymmetric, but others are not.

The cam phaser and one end of the camshaft are supported by a mount 46 which is either part of the engine case or fixed to the engine case. A radial bearing interface 48 is established between camshaft 18 and mount 46. A first thrust interface 50 is formed between camshaft 18 and mount 46. A second thrust interface 52 is formed between rear cover 40 and mount 46. The thrust surface of rear cover includes a number of radial channels as best viewed at 54 in FIG. 3. An oil passageway 56 is provided in mount 46 through which pressurized fluid is fed to radial bearing interface 48.

Rotor 36 is fixed to camshaft 18, either directly or via intermediate components. Stator 34 is fixed to front cover 38 and rear cover 40. For example, bolts may extend through rear cover 40 and stator 34 and engage threads in front cover 38. Reservoir cover 42 is fixed to stator 34, either directly or via intermediate components, such that reservoir 58 is formed between rear cover 40 and reservoir cover 42. Oil control valve housing 24 is fixed to camshaft 18 and extends through rotor 36, which is hollow. Timing wheel 22 is fixed to rotor 36 either directly or via intermediate components such as oil control valve housing 24. Camshaft 18, oil control valve 24, rotor 36, and timing wheel 22 all rotate as a unit, having substantially the same rotational speed and rotational position, subject to slight shaft twist due to torsional compliance. Similarly, stator 34, rear cover 40, reservoir cover 42, and front cover 38 all rotate as a unit.

Hydraulic unit 26 fits within hollow oil control valve housing 24 and rotates therewith. Spool 28 fits within hydraulic unit 26. A cavity 60 is formed between hydraulic unit 26 and spool 28 between lands 62 and 64 of spool 28. Spring 32, housed within spring cavity 31 located at the rear or camshaft end of the oil control valve assembly, biases spool 28 toward the front with respect to hydraulic unit 26. At the circumferential location illustrated in FIG. 5, fluid passageway 66 is formed between hydraulic unit 26 and oil control valve housing 24. Passageway 66 directs pressurized fluid from a hollow core of camshaft 18 into cavity 60.

Figure 6:
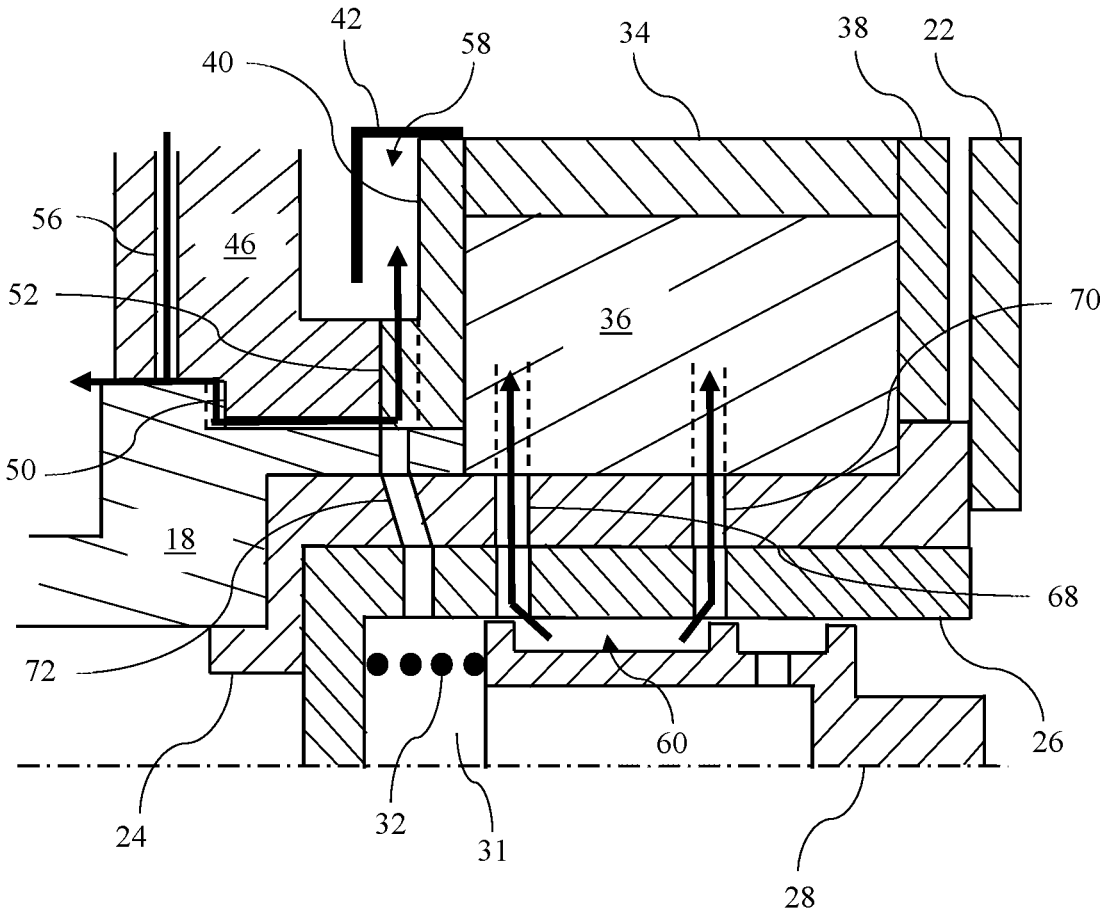
FIG. 6 is a second cross section view of the cam phaser and associated actuation mechanism during steady state operation.
Figure 7:
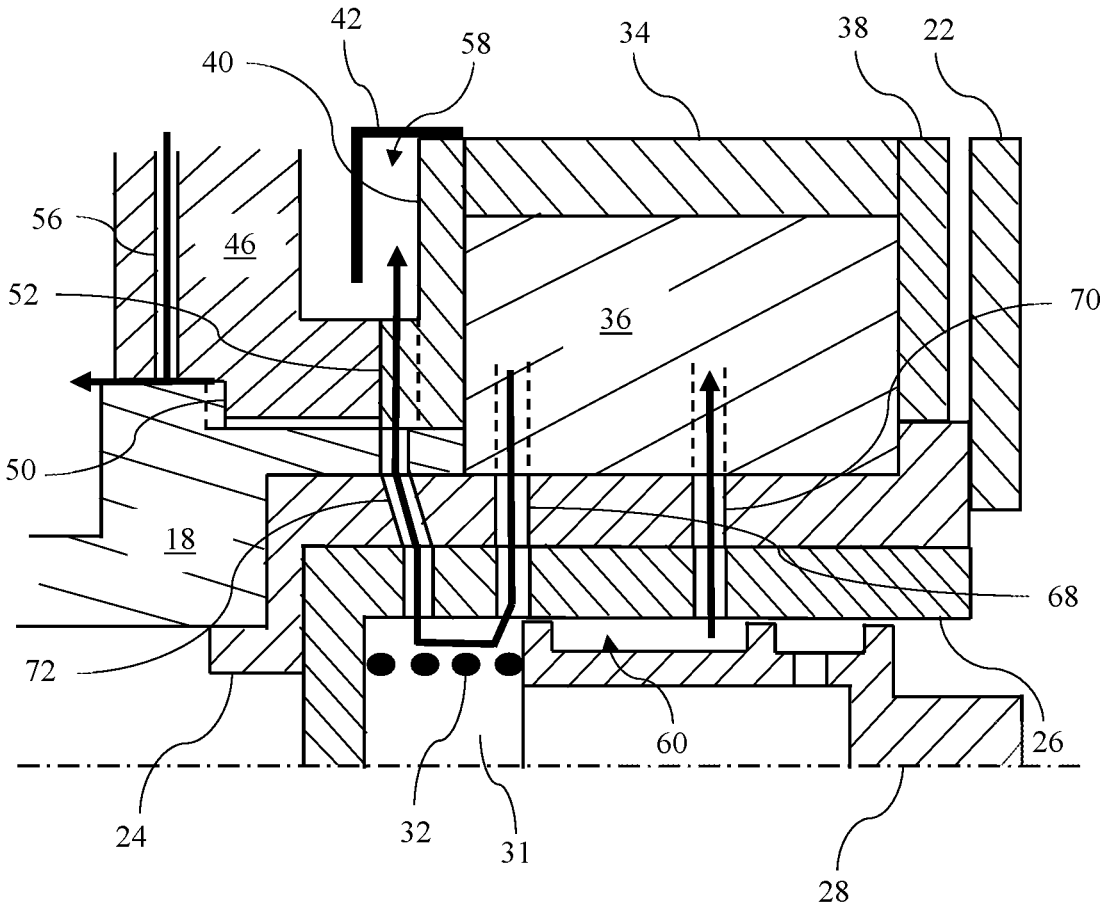
FIG. 7 is a second cross section view of the cam phaser and associated actuation mechanism during adjustment in a first direction.
Figure 8:
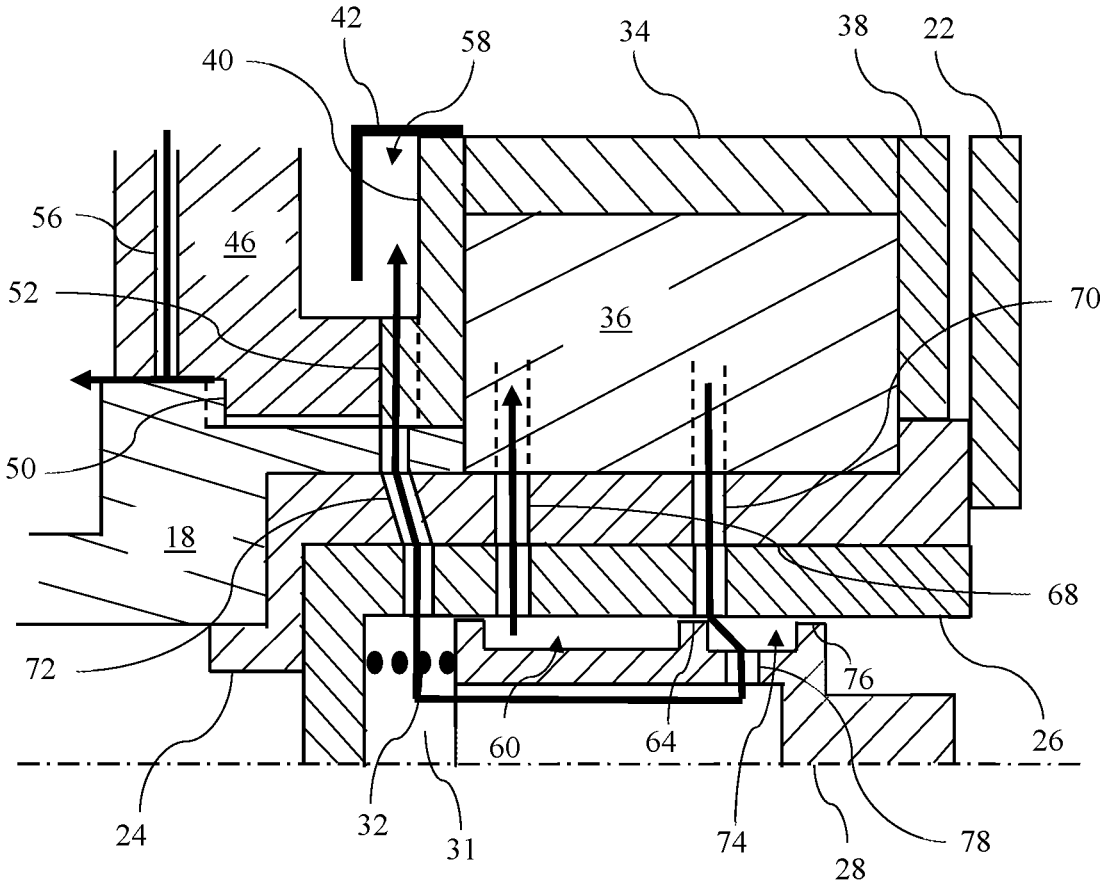
FIG. 8 is a second cross section view of the cam phaser and associated actuation mechanism during adjustment in a second direction.

FIGS. 6-8 are conceptual cross-sections of the cam phase adjustment mechanism taken at a different circumferential location than the cross section of FIG. 5. For example, the cross sections of FIG. 6-8 may be in a plane that is offset by 90 degrees from the cross section of FIG. 5. Several fluid passageways are formed at the circumferential location of FIGS. 6-8. Fluid passageway 68 extends through hydraulic unit 26, oil control valve housing 24, and rotor 36 into each of the A-chambers. Similarly, fluid passageway 70 extends through hydraulic unit 26, oil control valve housing 24, and rotor 36 into each of the B-chambers. Finally, fluid passageway 72 extends through hydraulic unit 26, oil control valve housing 24, and camshaft 18.

FIG. 6 illustrates the position of spool 28 during steady state operation with rotor 36 remaining in a constant rotational position relative to stator 34. Pressurized fluid flows to both the A-chambers via passageway 68 and to the B-chambers via passageway 70. Some of the lubrication fluid supplied to bearing interface 48 flows past thrust interface 50 (though channels formed between the components) and thrust interface 52 (through channels 54) to reservoir 58. Thus, the reservoir remains full even through long periods of steady state operation.

FIG. 7 illustrates the position of spool 28 while rotor 36 is being actively rotated counter-clockwise relative to stator 34. Spool 28 is moved to this position by relaxing the magnetic force exerted by solenoid 30 such that spring 32 extends pushing spool 28 rightward. In this condition, pressurized fluid is supplied to the B-chambers via cavity 60 and passageway 70. Fluid in the A-chambers is released into passageway 68 from which it flows via spring cavity 31, passageway 72, and channels 54 to reservoir 58. The fluid released from the A-chambers flows in an axially rearward direction within the spring cavity 31 to reach the passageway 72.

FIG. 8 illustrates the position of spool 28 while rotor 36 is being actively rotated clockwise relative to stator 34. Spool 28 is moved to this position by increasing the electrical current to solenoid 30 such that solenoid 30 pushes spool 28 leftward, compressing spring 32. A cavity 74 is formed between hydraulic unit 26 and spool 28 between lands 64 and 76 of spool 28. A passageway 78 connects cavity 74 to a hollow core of spool 28. In this condition, pressurized fluid is supplied to the A-chambers via cavity 60 and passageway 68. Fluid in the B-chambers is released into passageway 70 from which it flows via cavity 74, passageway 78, the hollow core of spool 28, spring cavity 31, passageway 72, and channels 54 to reservoir 58. The fluid released from the B-chambers flows in an axially rearward direction within the hollow core of the spool 28 and the spring cavity 31 to reach the passageway 72.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. As such, to the extent any embodiments are described as less desirable than other embodiments or prior art implementations with respect to one or more characteristics, these embodiments are not outside the scope of the disclosure and can be desirable for particular applications.

What is claimed is:

1. A camshaft phaser comprising:

a stator;

a rotor;

front and rear covers fixed to the stator; the stator, rotor, and front and rear covers defining A-chambers and B-chambers wherein a volume ratio between the A-chambers and the B-chambers varies as a function of a rotational position of the rotor relative to the stator;

a fluid reservoir formed at an end of the camshaft phaser, the fluid reservoir fluidly connected to the A-chambers and the B-chambers by one-way valves; and an oil control valve assembly disposed within the rotor; and the fluid reservoir configured to: i) receive fluid from the oil control valve assembly, and ii) receive fluid directly from a mount configured to support a camshaft.

2. The camshaft phaser of claim 1 wherein the rear cover defines radial channels configured to route the fluid from the mount to the fluid reservoir.

3. The camshaft phaser of claim 1 wherein the oil control valve assembly is configured to:

in a first mode, route pressurized fluid to both the A-chambers and the B-chambers simultaneously;

in a second mode, route the pressurized fluid to the A-chambers while routing fluid from the B-chambers to the fluid reservoir; and in a third mode, route the pressurized fluid to the B-chambers while routing fluid from the A-chambers to the fluid reservoir.

4. The camshaft phaser of claim 3 wherein the rear cover defines radial channels configured to route the fluid from the B-chambers to the fluid reservoir and the fluid from the A-chambers to the fluid reservoir while in the second and third mode, respectively.

5. The camshaft phaser of claim 4 wherein the radial channels are configured to route the fluid from the mount to the fluid reservoir while in the first mode.

6. The camshaft phaser of claim 4 wherein the oil control valve assembly comprises a hydraulic unit and a spool valve having three lands, the hydraulic unit and spool valve defining a first and a second cavity, the hydraulic unit defining a first passageway leading to the radial channels, a second passageway leading to the A-chambers, and a third passageway leading to the B-chambers, wherein the second cavity is fluidly connected to the first passageway.

7. A camshaft phaser comprising:

a stator;

a rotor;

front and rear covers fixed to the stator; the stator, rotor, and front and rear covers defining A-chambers and B-chambers wherein a volume ratio between the A-chambers and the B-chambers varies as a function of a rotational position of the rotor relative to the stator;

a fluid reservoir formed at an end of the camshaft phaser, the fluid reservoir fluidly connected to the A-chambers and the B-chambers by one-way valves; and, an oil control valve assembly having a spool valve; and, in a first position of the spool valve, the spool valve is configured to route fluid from the A-chambers to the fluid reservoir in an axially rearward direction within the oil control valve assembly; and, in a second position of the spool valve, the spool valve is configured to route fluid from the B-chambers to the fluid reservoir in the axially rearward direction within the oil control valve assembly.

8. The camshaft phaser of claim 7, wherein in at least one of the first position or the second position of the spool valve, the spool valve is configured to route; i) the fluid from the A-chambers to the fluid reservoir, or ii) the fluid from the B-chambers to the fluid reservoir, in the axially rearward direction within a hollow core of the spool valve.

9. The camshaft phaser of claim 7, wherein in both the first position and the second position of the spool, valve, the spool valve is configured to route; i) the fluid from the A-chambers to the fluid reservoir, and ii) the fluid from the B-chambers to the fluid reservoir, respectively, in an axially rearward direction within a spring cavity, the spring cavity configured for housing a bias spring for the oil control valve assembly.

10. The camshaft phaser of claim 7, wherein the oil control valve assembly is configured to:

in a first mode, route pressurized fluid to both the A-chambers and the B-chambers simultaneously;

in a second mode, route the pressurized fluid to the A-chambers while routing the fluid from the B-chambers to the fluid reservoir; and in a third mode, route the pressurized fluid to the B-chambers while routing the fluid from the A-chambers to the fluid reservoir.

11. The camshaft phaser of claim 10 wherein the rear cover defines radial channels configured to route the fluid from the B-chambers to the fluid reservoir and the fluid from the A-chambers to the fluid reservoir while in the second and third mode, respectively.

12. The camshaft phaser of claim 11 wherein the radial channels are configured to route fluid from a mount to the fluid reservoir while in the first mode, the mount configured to support a camshaft.

13. The camshaft phaser of claim 11 wherein the oil control valve assembly comprises a hydraulic unit and a spool valve having three lands, the hydraulic unit and spool valve defining a first and a second cavity, the hydraulic unit defining a first passageway leading to the radial channels, a second passageway leading to the A-chambers, and a third passageway leading to the B-chambers, wherein the second cavity is fluidly connected to the first passageway.

14. A camshaft phaser comprising:

a stator;

a rotor;

front and rear covers fixed to the stator; the stator, rotor, and front and rear covers defining A-chambers and B-chambers wherein a volume ratio between the A-chambers and the B-chambers varies as a function of a rotational position of the rotor relative to the stator; and a fluid reservoir fluidly connected to the A-chambers and the B-chambers by one-way valves;

an oil control valve assembly disposed within the rotor, the oil control valve assembly having a spool valve; and the spool valve at least partially defining a spring cavity configured for housing a bias spring within the oil control valve assembly, the spring cavity forming at least a portion of: i) a first fluid path from the A-chambers to the fluid reservoir, and ii) a second fluid path from the B-chambers to the fluid reservoir.

15. The camshaft phaser of claim 14, wherein the spool valve at least partially defines a first cavity and a second cavity, the first cavity configured t deliver pressurized fluid to a least one of the A-chambers or the B-chambers, and the second cavity configured to exit fluid from the B-chambers.

16. The camshaft phaser of claim 15 wherein the spool valve includes a hollow core and a radial passageway, the radial passageway fluidly connecting the second cavity to the hollow core, and the hollow core fluidly connecting the radial passageway to the spring cavity, wherein the radial passageway, hollow core, and the spring cavity define at least a portion of the second fluid path from the B-chambers to the fluid reservoir.

17. The camshaft phaser of claim 14, wherein the oil control valve assembly is configured to:

in a first mode, route pressurized fluid to both the A-chambers and the B-chambers simultaneously;

in a second mode, route the pressurized fluid to the A-chambers while routing fluid from the B-chambers to the fluid reservoir; and in a third mode, route the pressurized fluid to the B-chambers while routing fluid from the A-chambers to the fluid reservoir.

18. The camshaft phaser of claim 14, wherein the oil control valve assembly further comprises a housing and a hydraulic unit, the hydraulic unit at least partially disposed within the housing and the spool valve at least partially disposed within the hydraulic unit.

19. The camshaft phaser of claim 18, wherein the hydraulic unit forms a fluid passageway with the housing, the fluid passageway configured to route pressurized fluid from a camshaft to a cavity defined by the hydraulic unit and the spool valve, the cavity configured to deliver the pressurized fluid to at least one of the A-chambers or the B-chambers.

20. The camshaft phaser of claim 14, wherein the spring cavity is arranged at a camshaft end of the oil control valve assembly.

* * * * *